US005762198A

United States Patent [19]

Hung

[11] Patent Number: 5,762,198

[45] Date of Patent: Jun. 9, 1998

[54] AIR PROTECTIVE BAG STRUCTURE

[76] Inventor: Chichuan Hung, 10th FL-14, No. 186, Nanking E. Rd., Sec. 4, Taipei, Taiwan

[21] Appl. No.: 784,597

[22] Filed: Jan. 21, 1997

[30] Foreign Application Priority Data

Jan. 22, 1996 [CN] China ..... 96 2 29154.4

[51] Int. Cl.[6] ..... B65D 85/30

[52] U.S. Cl. ..... 206/522; 383/3

[58] Field of Search ..... 206/522, 521, 206/591; 383/3

[56] References Cited

U.S. PATENT DOCUMENTS

| | | | |
|---|---|---|---|
| 3,346,101 | 10/1967 | Pestka | 206/522 X |
| 4,215,778 | 8/1980 | Kovins | 206/522 X |
| 5,263,587 | 11/1993 | Elkin et al. | 206/522 |
| 5,427,830 | 6/1995 | Pharo | 383/3 X |
| 5,624,035 | 4/1997 | Kim | 206/522 |

FOREIGN PATENT DOCUMENTS

| | | | |
|---|---|---|---|
| 2385606 | 12/1978 | France | 206/522 |
| 2389547 | 1/1979 | France | 206/522 |

*Primary Examiner*—Bryon P. Gehman

*Attorney, Agent, or Firm*—Pro-Techtor International Services

[57] ABSTRACT

A protective air bag structure which is mainly composed of multiple pliable segments joining several air bag bodies. There are many adhesive lines—in both vertical and horizontal directions—on the pliable segments, by which the thickness after inflation for the air bag's pliable segments is limited. There are several horizontal air access routes created within these adhesive lines. The sections, which are not completely closed, form air connecting access routes along the adhesive lines between each air bag body.

4 Claims, 6 Drawing Sheets

AIR PROTECTIVE BAG STRUCTURE

BACKGROUND OF THE INVENTION

1. Field of the Invention

The present invention relates to a protective air bag structure, and more particularly to a device which can protect the surfaces of an object to prevent the object from being damaged by shock after it is packed in the protective air bag device.

2. Description of the Prior Art.

During the process of carrying or delivering articles, it is very difficult to provide sound protection for them due to unforeseen shocks to the packages. Therefore, some delicate and fragile goods may sustain damage. This most frequently occurs on goods such as glassware, electronic products, and other articles with fragile exterior covers. The conventional ways to avoid such damage are:

(1) To wrap the object entirely in polyethylene fiber with air-bubbles. This kind of material can provide practical shock resistance for small articles. However, when it is used for large goods, it is time-wasting because several layers must be attached, and the protection is not as good.

(2) To fill the cartons/packages with sliced or beaded polyester. This is very inconvenient, and the material cannot be recycled which will result in pollution.

In view of these methods, the conventional protective air bags are composed of several air bag bodies. The structure of a standard protective air bag is that shown in FIG. 1. The bag is formed by several individual air bag bodies 4 connected to each other. Each of the aforesaid air bag bodies 4 are separated from the other by adhesive lines 5. There are air connecting access means 51 at both sides of the adhesive separating line 5 which allow the air in every air bag body 4 to flow between each other. There is an air intake 41 in at least on of the air bag bodies 4 to allow an appropriate volume of air to be introduced to allow each of the air bag bodies to be inflated adequately to protect the goods from being damaged.

However, with the conventional protective air bag, the length of the air bag bodies 4, which are separated by adhesive lines 5, is fixed. Hence, the air bag bodies 4 can only enclose and provide sound protection for articles in a certain size range. If the discrepancy in size between the air bag and the article is large, it will result in the condition shown in FIG. 2, and bring about the following disadvantages while in use:

(1) If articles to be enclosed by air bag bodies 4 are too large, then they can not be fully surrounded. The defect of poor shock resistance will arise from either unequal cushion thickness on the sides of the article, or parts of the article are not enclosed.

(2) Due to the size of articles that do not fully match those of the air bag bodies 4, corners of the articles press against surfaces of these air bag bodies 4 which causes air leakage and loss of protection.

To completely prevent the defects as above mentioned, air bag bodies 4 which are tailor-made to the size of the articles to be enclosed are necessary. This approach is very expensive.

SUMMARY OF THE INVENTION

The primary object of the present invention is to provide a protective air bag structure which is mainly composed of multiple pliable segments joining several air bag bodies.

There are many adhesive lines—in both vertical and horizontal directions—on the pliable segments, by which the thickness after inflation for the air bag's pliable segments is limited. There are several horizontal air access routes created within these adhesive lines. The sections, which are not completely closed, form air connecting access routes along the adhesive lines between each air bag body.

Another object of the present invention is to provide a protective air bag structure which can use pliable segments to protect objects of varying sizes. When the air bags are inflated and used to enclose an object, the pliable segments can be adjusted to cover the corners of the object. With this unique feature, every surface of the object is evenly and completely protected by an air bag body.

In one embodiment of the present invention, there are multiple side air bag bodies at the flanks of the central air bag bodies. There are sticking attachments at both exterior sides of the side air bag bodies and at the ends of the central air bag bodies which are used to secure the protective air bag after the object is packed.

The detailed structure, the applied principles, and the function of the present invention can be best understood from the following detailed description of the preferred embodiment and the accompanying drawings wherein:

DETAILED DESCRIPTION OF THE PREFERRED EMBODIMENT

Figure 1:
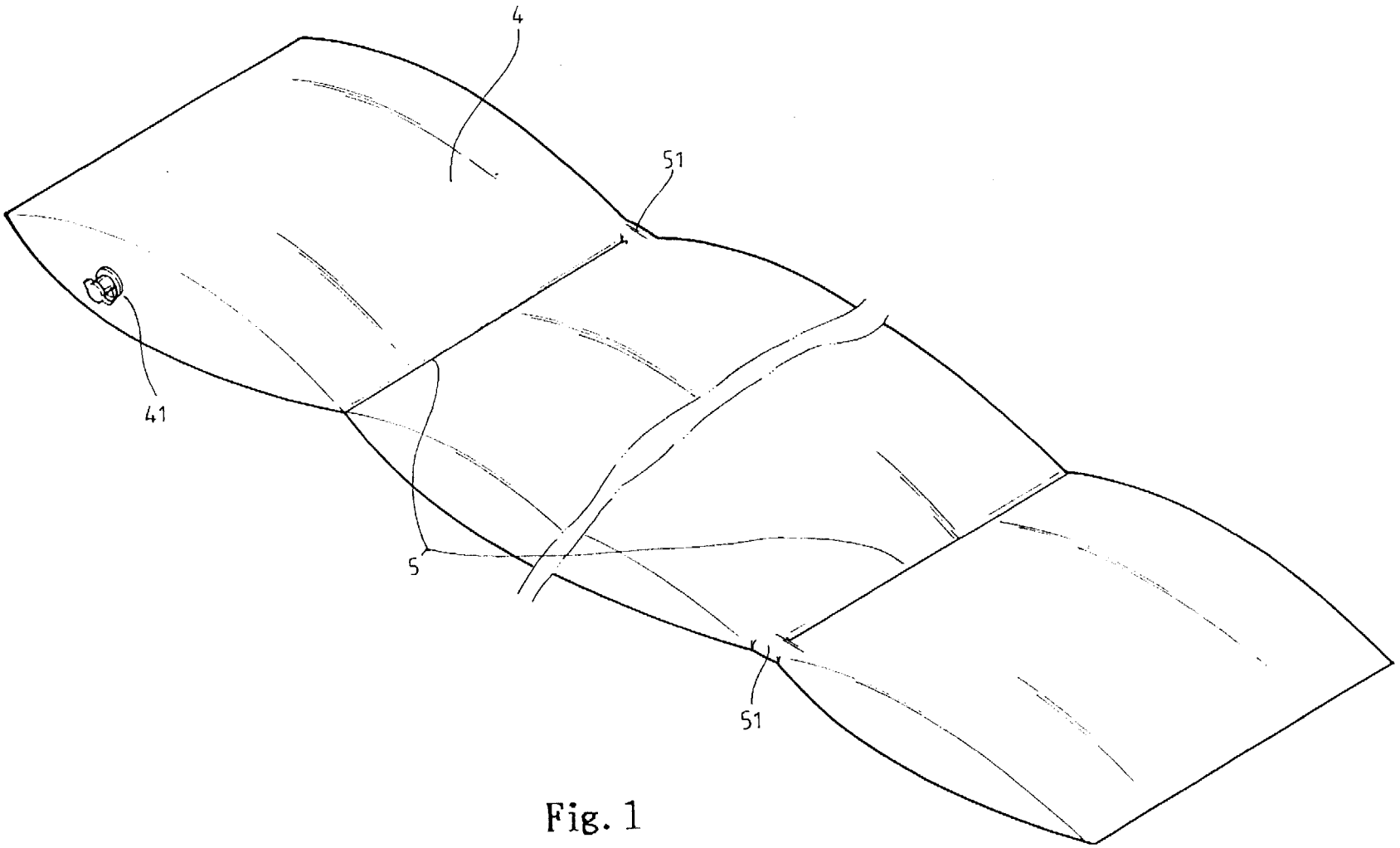
Fig. 1 Prior Art
FIG. 1 is a perspective view of the conventional protective air bag.
Figure 2:
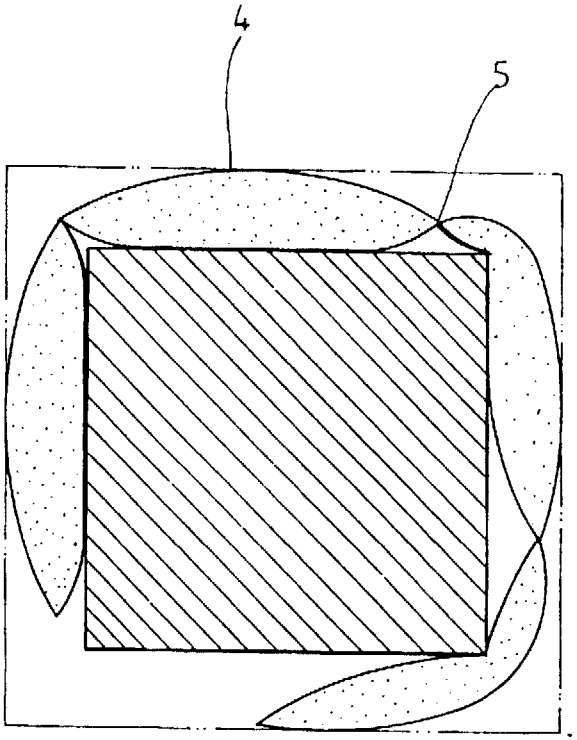
Fig. 2 Prior Art
FIG. 2 is a view of the device of FIG. 1, showing an object partially enclosed by the conventional protective air bag.
Figure 3:
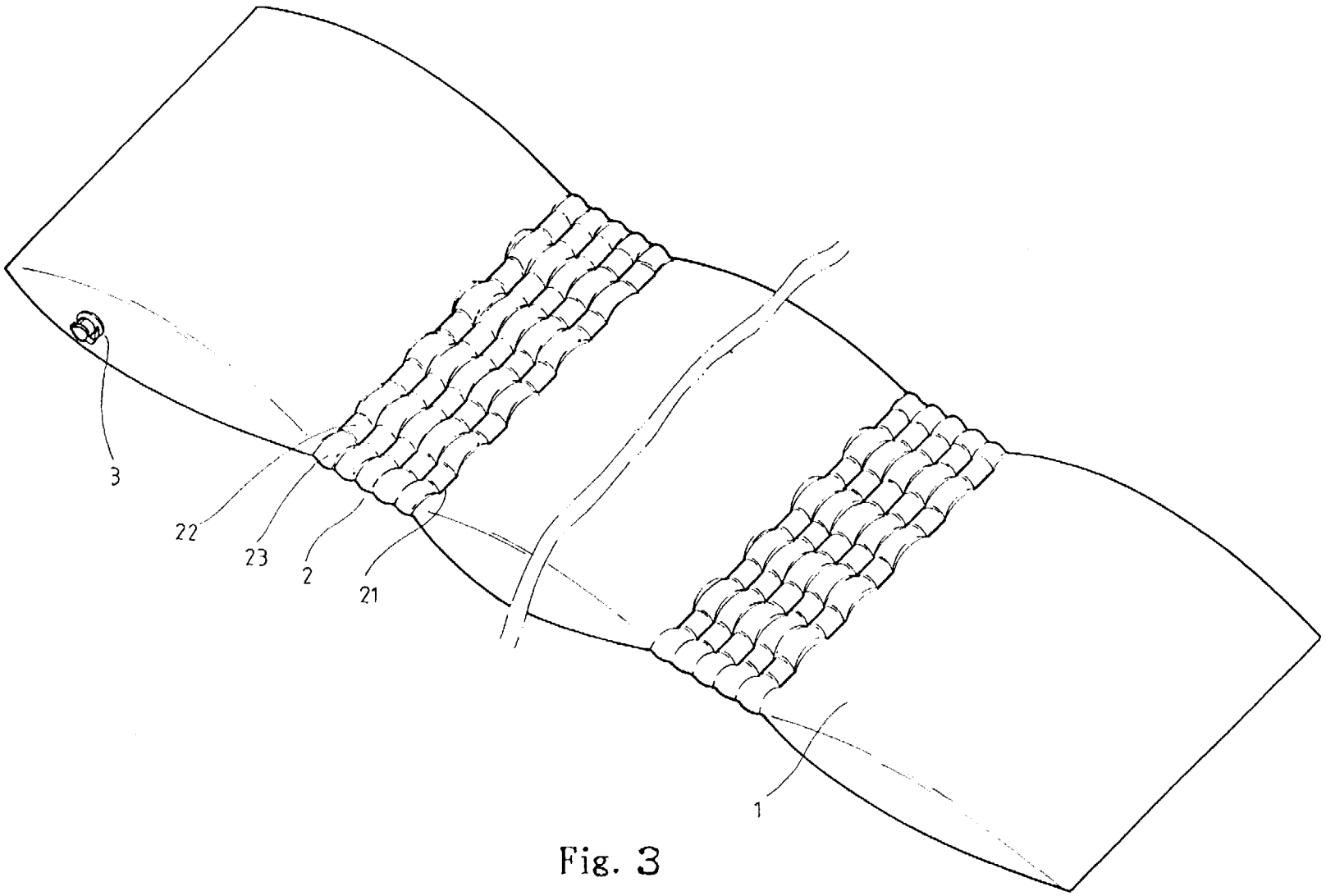
FIG. 3 is a perspective view of the present invention.

Referring first to FIG. 3, the present invention mainly includes: a plurality of air bag bodies 1, pliable segments 2, and an air intake 3. The air bag bodies 1 are connected by the pliable segments 2. The pliable segments 2 are air bag bodies with middle portions connected to each other. Several adhesive lines 21—in both vertical and horizontal directions—are located on said pliable segments 2. The adhesive lines 21 in the liable segments 2 form air access routes 22 which allow the air in the air bag bodies to flow between each other. When inflated, the pliable segments 2 are thinner than the air bag bodies 1 so that the pliable segments 2 can be easily folded.

There are several air connecting access points 23 at both sides of the adhesive lines 21. At least one air intake 3 is provided in one of the air bag bodies 1 to allow an appropriate volume of air to be injected.

Figure 4B:
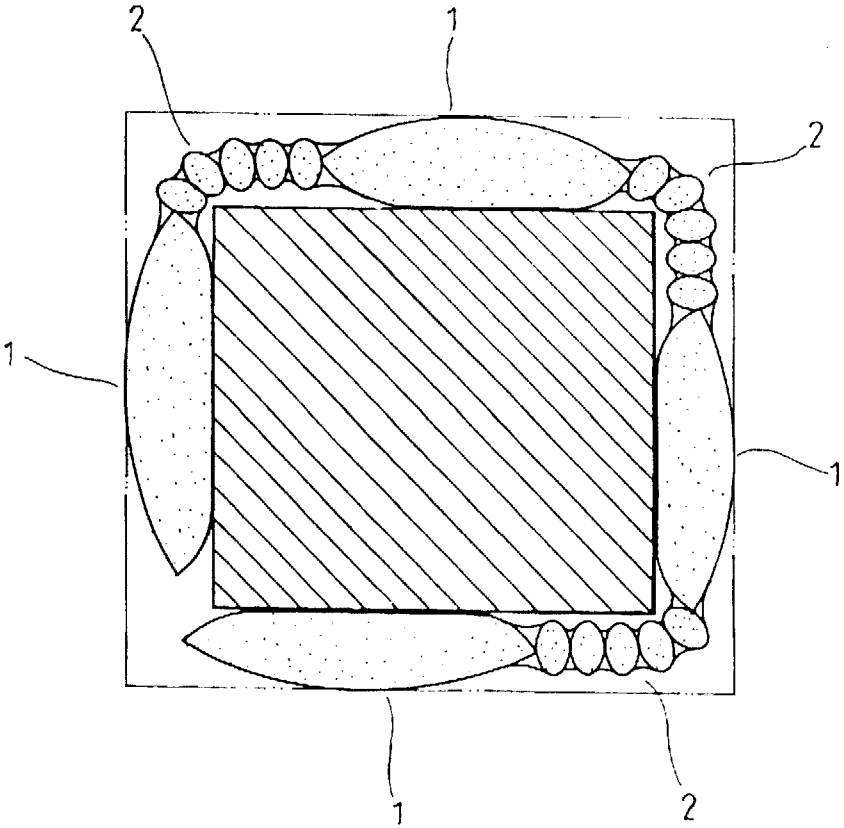
FIG. 4B shows the device enclosing a different sized object.
Figure 4A:
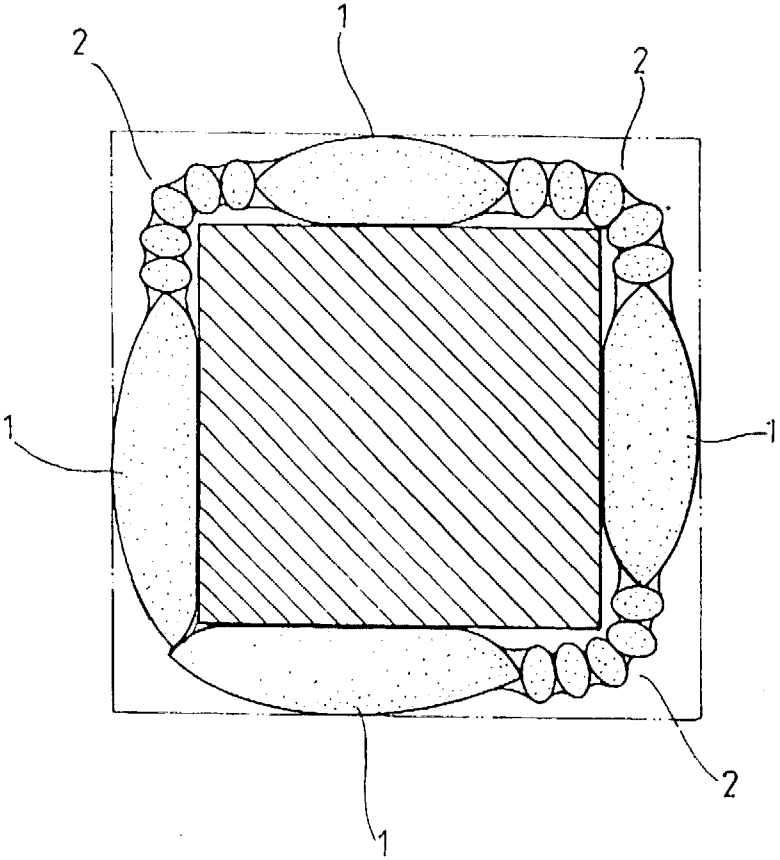
FIG. 4A is a view showing the device of the present invention enclosing an object.

Referring now to FIG. 4A, when the perimeter of an object to be enclosed is of exactly compatible size with the shock resistant air bags, the each corner of the object touches a middle portion of the pliable segments 2. Each air bag body 1 is placed flat on a surface of the object.

When the size of the object to be enclosed is changed, as in FIG. 4B, the pliable segments 2 still allows the protective air bag to safely enclose the object. The corners of the object may not contact the middle of the pliable segments 2, but because the pliable segments 2 bend easily, the object is still safely enclosed.

Figure 5:
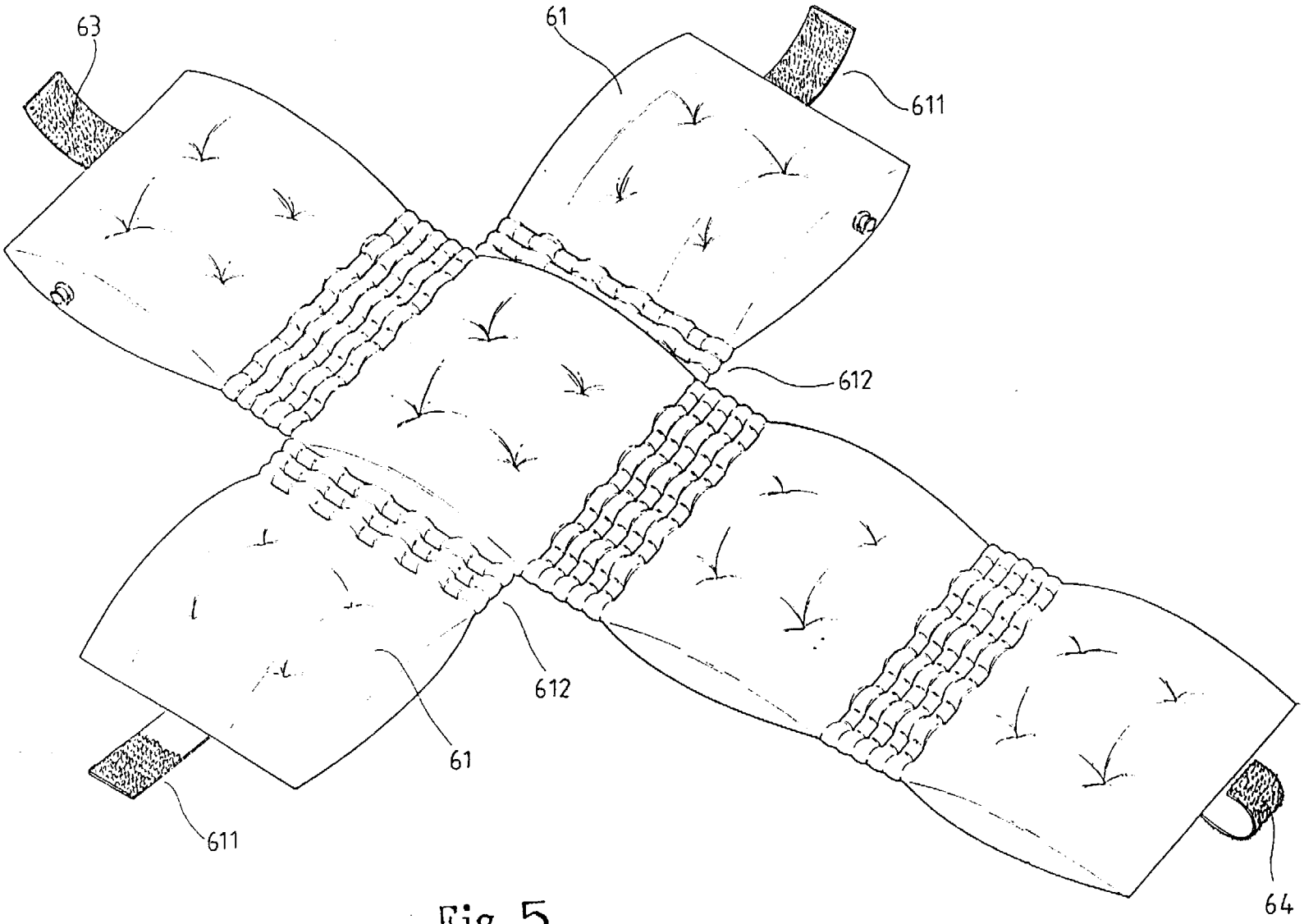
FIG. 5 is a perspective view for a preferred embodiment of the present invention.
Figure 6:
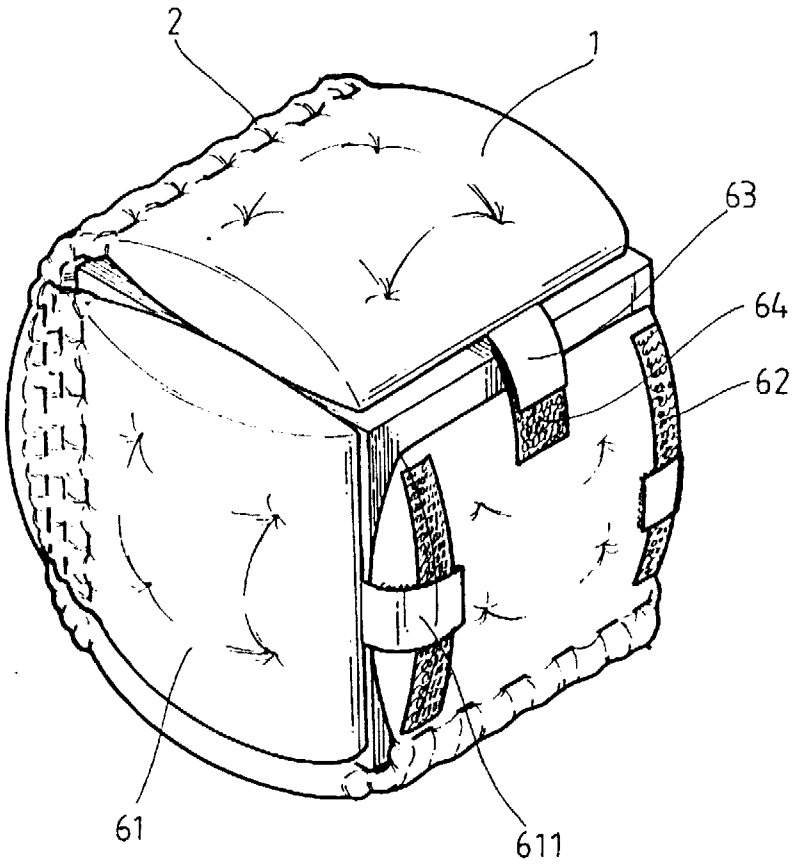
FIG. 6 shows the device shown in FIG. 5 enclosing an object.

FIGS. 5 and 6 illustrate an embodiment in which at distal ends of the central air bag bodies 1, there is a sticking attachment 63 and a corresponding sticking stand 64. On the lateral sides of the central air bag bodies 1, there are two side air bag bodies 61 that extend outward and that are connected to a central air bag body by pliable segments 612. There are corresponding sticking attachments 611 and sticking stands 62 situated at the outer side of the side air bag bodies 61 and the back of another central air bag body 1 respectively. This allows the air bag bodies 1 and the side air bag bodies 61 to be placed flat on the surfaces of the object and secure in place.

The above description and accompanying drawings are used only for illustrating preferred embodiments of the present invention and are not intended to limit the scope thereof. Many derivations or modifications of the preferred embodiments can be made without departing from the spirit of the present invention.

What is claimed is:

1. A protective air bag device comprising:

a plurality of air bag bodies, a plurality of pliable segments comprising a plurality of vertical and horizontal adhesive lines, said adhesive lines divide each said pliable segment into a plurality of adjoining air bags, said adhesive lines limit an inflated thickness of each said air bag so that each said pliable segment folds easily, and at least one air inlet in one of said air bag bodies; wherein said pliable segments connect said air bag bodies, said pliable segments further include a plurality of air access routes so that air moves between said air bag bodies and said air bags, said protective air bag device is adapted to enclose an object, said pliable segments able to contact corners of the object, a position of said pliable segments on the corners is adjustable to compensate for varying sizes of objects to be enclosed within said protective air bag device.

2. The protective air bag device of claim 1 wherein:

at least one interval point attaches an upper surface of at least one of said air bag bodies to a lower surface of said one of said air bag bodies such that an inflated thickness of said one of said air bag bodies is limited by said at least one interval point.

3. The protective air bag device of claim 1 wherein:

said pliable segments include a plurality of horizontal air access routes that allows the pliable segments to be fully inflated.

4. The protective air bag device of claim 3 wherein:

at least one interval point attaches an upper surface of at least one of said air bag bodies to a lower surface of said one of said air bag bodies such that an inflated thickness of said one of said air bag bodies is limited by said at least one interval point.

* * * * *